US006368201B1

(12) United States Patent
Bitz

(10) Patent No.: US 6,368,201 B1
(45) Date of Patent: Apr. 9, 2002

(54) CUTTING APPARATUS

(76) Inventor: Vincent M. Bitz, 707 Albany Dr., Bismarck, ND (US) 58504

( * ) Notice: Subject to any disclaimer, the term of this patent is extended or adjusted under 35 U.S.C. 154(b) by 0 days.

(21) Appl. No.: 09/563,994

(22) Filed: May 3, 2000

(51) Int. Cl.[7] ..... B23F 21/03
(52) U.S. Cl. ..... 451/541; 451/540; 451/358
(58) Field of Search ..... 451/541, 544, 451/552, 540, 548, 546, 547, 344, 358

(56) References Cited

U.S. PATENT DOCUMENTS 3,142,138 A * 7/1964 Kean et al. ..... 451/541
3,159,952 A * 12/1964 Lipkins ..... 451/541
5,052,153 A * 10/1991 Wiand ..... 451/541
5,092,083 A * 3/1992 Raffaelli ..... 451/541
5,259,148 A * 11/1993 Wiand ..... 451/541

* cited by examiner

*Primary Examiner*—Eileen P. Morgan
(74) *Attorney, Agent, or Firm*—Michael S. Neustel

(57) ABSTRACT

A cutting apparatus for creating a convex shape into a piece of wood creating the appearance of an eye. The inventive device includes a concave stone, a plurality of slots within the concave stone, and a drive shaft attached to the center portion of the concave stone. The concave stone preferably includes a layer of a diamond grit material or similar course material for engaging a piece of wood. The shaft is connected within a conventional grinder tool that rotates the concave stone at rotational speeds of up to 45,000 RPM.

14 Claims, 4 Drawing Sheets

CUTTING APPARATUS

BACKGROUND OF THE INVENTION

1. Field of the Invention

The present invention relates generally to cutting blades and more specifically it relates to a cutting apparatus for creating a convex shape into a piece of wood creating the appearance of an eye.

Many woodcarvers create wooden objects that include the likeness of animals and humans. Woodcarvers utilize various cutting tools such as grindstones to create the effects within the wood. However, a very difficult portion for woodcarvers to create is the eye of the individual or animal. Hence, there is a need for a cutting apparatus that easily creates concaved shapes within a piece of wood similar in appearance to an eye.

2. Description of the Prior Art

Grindstones have been in use for years. Typically, a grindstone is comprised of various cylindrical shapes that allow the individual to grind away portions of a piece of wood. The grindstones come in various sizes and textures depending upon the usage desired. Another type of tool utilized by woodworkers is an "eye punch" which is basically a punch with a concave end that creates a convex shape. However, conventional grindstones and punches are incapable of easily recreating the appearance of an eye into a piece of wood.

Examples of patented cutting devices include U.S. Pat. No. 3,159,952 to Lipkins; U.S. Pat. No. 3,382,743 to Trevathan; U.S. Pat. No. 3,088,254 to Lipkins; U.S. Pat. No. 3,374,586 to Stone; U.S. Pat. No. 5,092,083 to Raffaelli; U.S. Pat. No. 2,250,058 to Brooks; U.S. Pat. No. 2,366,767 to Brooks which are all illustrative of such prior art.

While these devices may be suitable for the particular purpose to which they address, they are not as suitable for creating a convex shape into a piece of wood creating the appearance of an eye. Conventional grindstones are incapable of creating a convex shape into a piece of wood.

In these respects, the cutting apparatus according to the present invention substantially departs from the conventional concepts and designs of the prior art, and in so doing provides an apparatus primarily developed for the purpose of creating a convex shape into a piece of wood creating the appearance of an eye.

SUMMARY OF THE INVENTION

In view of the foregoing disadvantages inherent in the known types of cutting devices now present in the prior art, the present invention provides a new cutting apparatus construction wherein the same can be utilized for creating a convex shape into a piece of wood creating the appearance of an eye.

The general purpose of the present invention, which will be described subsequently in greater detail, is to provide a new cutting apparatus that has many of the advantages of the cutting devices mentioned heretofore and many novel features that result in a new cutting apparatus which is not anticipated, rendered obvious, suggested, or even implied by any of the prior art cutting devices, either alone or in any combination thereof.

To attain this, the present invention generally comprises a concave stone, a plurality of slots within the concave stone, and a drive shaft attached to the center portion of the concave stone. The concave stone preferably includes a layer of a diamond grit material or similar course material for engaging a piece of wood. The shaft is connected within a conventional grinder tool that rotates the concave stone at rotational speeds of up to 45,000 RPM.

There has thus been outlined, rather broadly, the more important features of the invention in order that the detailed description thereof may be better understood, and in order that the present contribution to the art may be better appreciated. There are additional features of the invention that will be described hereinafter and that will form he subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a cutting apparatus that will overcome the shortcomings of the prior art devices.

A second object is to provide a cutting apparatus for creating a convex shape into a piece of wood creating the appearance of an eye.

Another object is to provide a cutting apparatus that is easy to utilize for creating the appearance of an eye into a piece of wood or other material.

An additional object is to provide a cutting apparatus that provides an efficient process to create a clean eye within a piece of wood.

A further object is to provide a cutting apparatus that creates attractive eyes within a carving.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
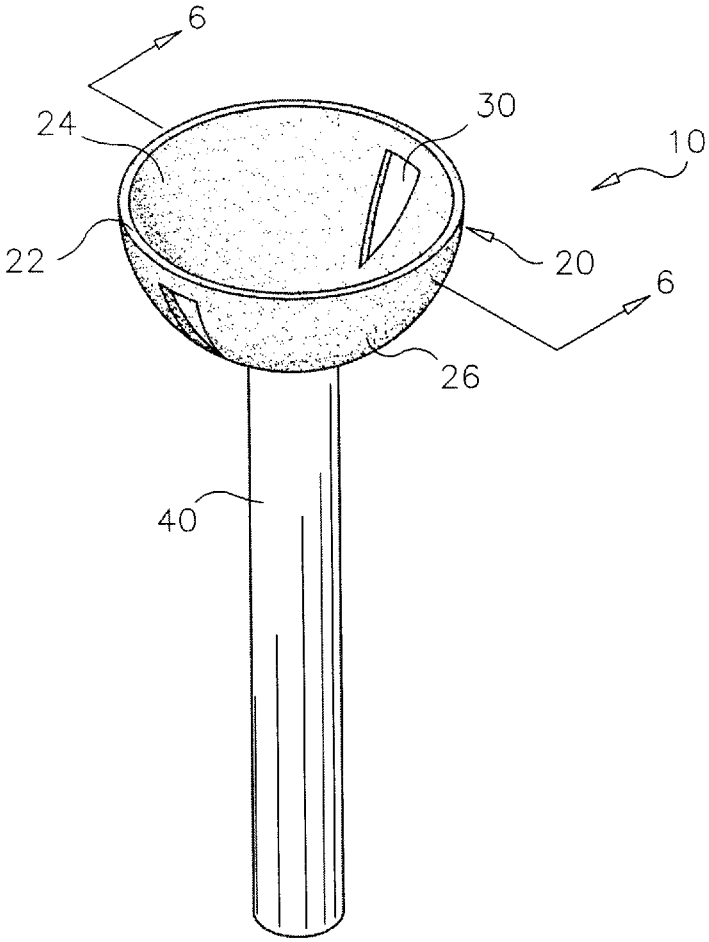
FIG. 1 is an upper perspective view of the present invention in an inverted position.

Turning now descriptively to the drawings, in which similar reference characters denote similar elements throughout the several views, FIGS. 1 through 7 illustrate a cutting apparatus 10, which comprises a concave stone 20, a plurality of slots 30 within the concave stone 20, and a drive shaft 40 attached to the center portion of the concave stone 20. The concave stone 20 preferably includes a layer of a diamond grit material or similar course material for engaging a piece of wood 12. The shaft 40 is connected within a conventional grinder tool that rotates the concave stone 20 at rotational speeds of up to 45,000 RPM.

As shown in FIGS. 1, 2, 3, 5, 6 and 7 of the drawings, the concave stone 20 is shaped similar to a bowl. The concave stone 20 includes a perimeter edge 22 that initially engages the wood 12 during cutting. The concave stone 20 further includes an interior surface 24 and an exterior surface 26 as shown in FIG. 1 of the drawings. The interior surface 24 and the exterior surface 26 preferably include a layer of diamond grit or similar material for increasing the cutting of the wood 12. The concave stone 20 can have various sizes and diameters depending upon the size of the eye desired to be created by the user.

Figure 6:
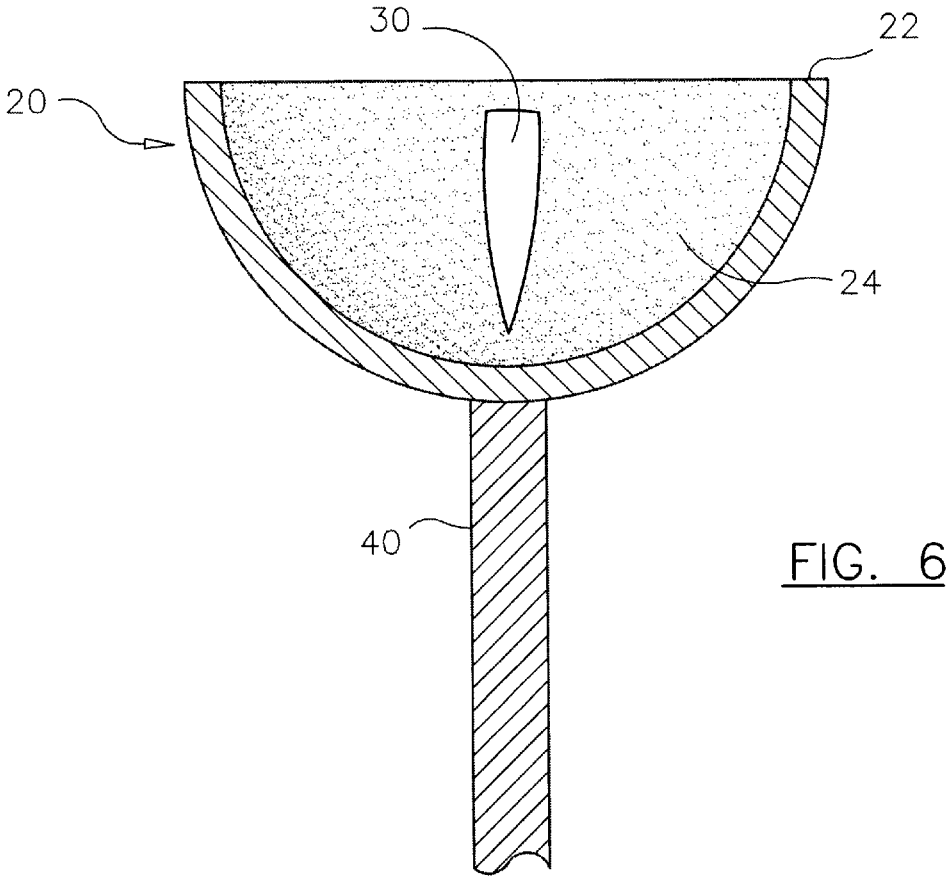
FIG. 6 is a cross sectional view taken along line 6—6 of FIG. 1.
Figure 7:
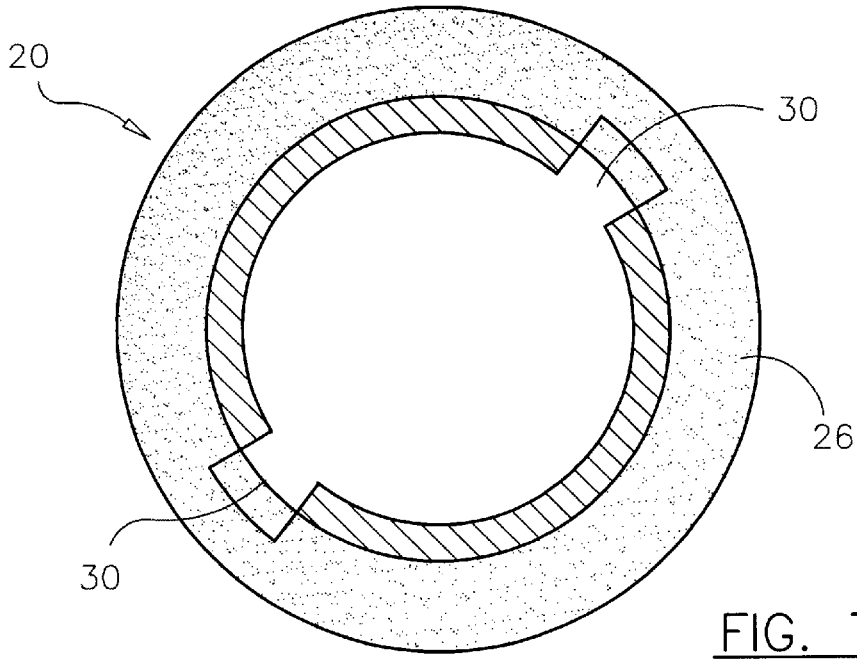
FIG. 7 is a cross sectional view taken along line 7—7 of FIG. 2.

As further shown in FIGS. 1, 2, 3, 5, 6 and 7 of the drawings, the concave stone 20 includes one or more slots 30 extending through the interior surface 24 to the exterior surface 26 to allow the removed wood 12 to escape the concave stone 20. The slots 30 are preferably broader near the edge 22 of the concave stone 20 as best shown in FIG. 6 of the drawings. The slots 30 may include a slanted blade portion for increasing the cutting action of the concave stone 20 with the wood 12 during use.

Figure 2:
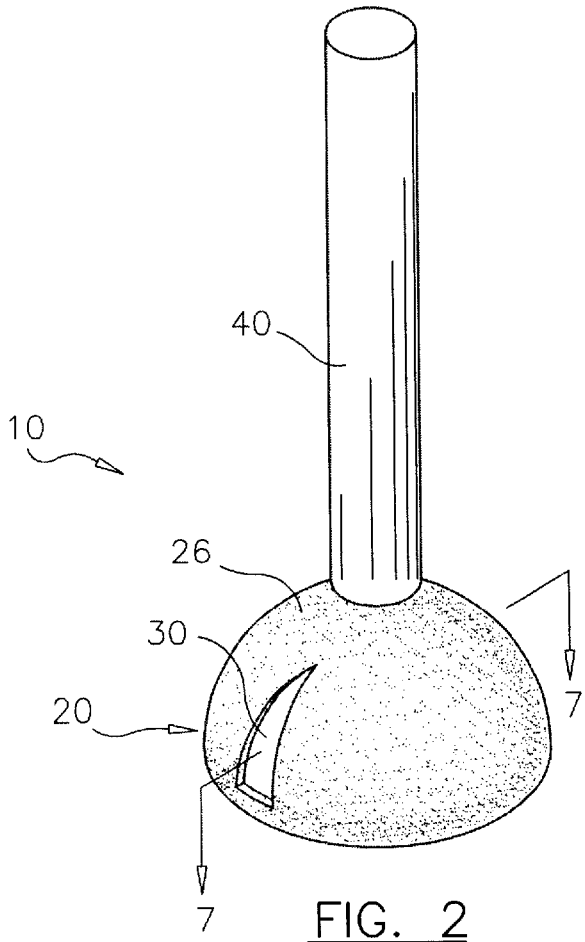
FIG. 2 is an upper perspective view of the present invention.
Figure 3:
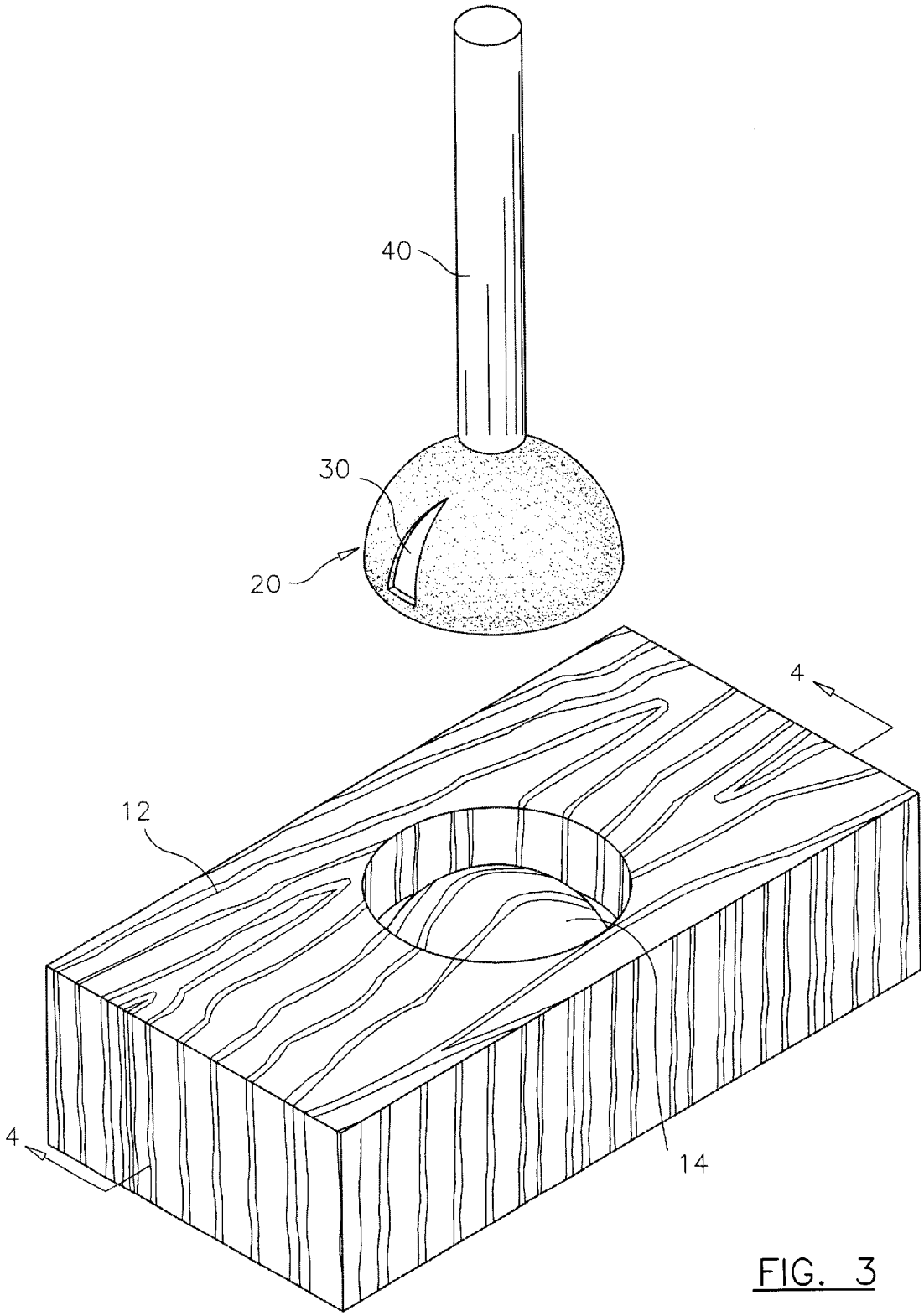
FIG. 3 is an upper perspective view of the present invention above a piece of wood.

As shown in FIGS. 1 through 3 of the drawings, a shaft 40 is secured to the exterior surface 26 of the concave stone 20. The shaft 40 extends a finite distance and is engagable by a conventional grinder tool that rotates the shaft 40 along with the concave stone 20 at high rotational velocities.

Figure 4:
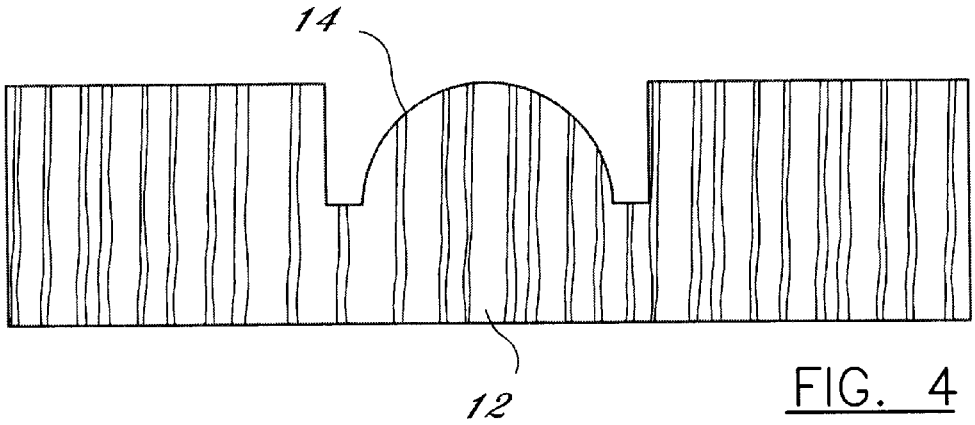
FIG. 4 is a cross sectional view taken along line 4—4 of FIG. 3.
Figure 5:
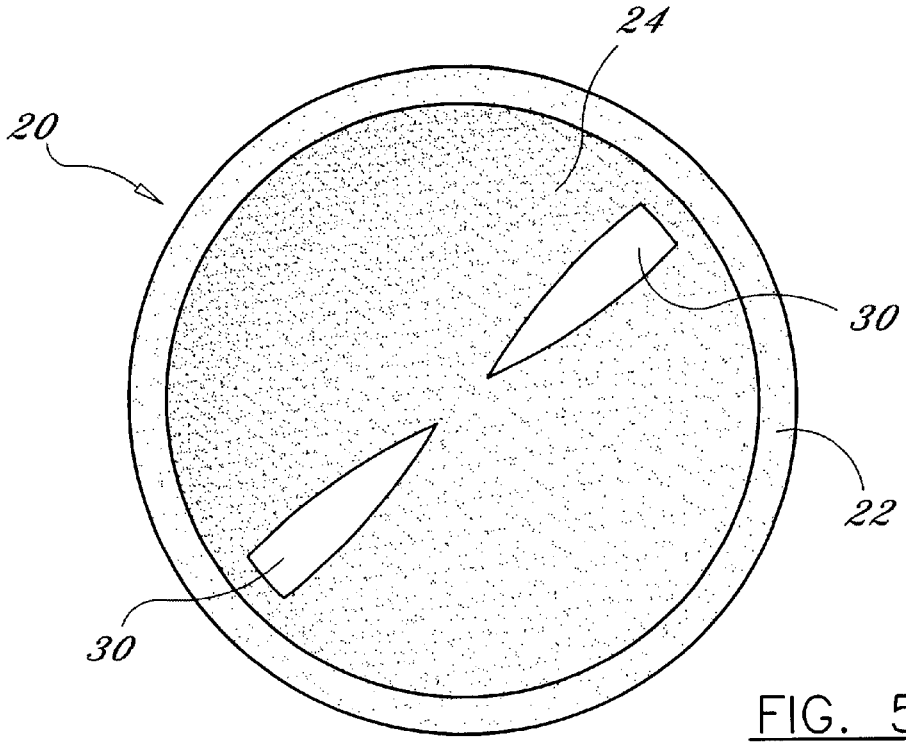
FIG. 5 is a bottom view of the present invention.

In use, the user secures the end of the shaft 40 opposite of the concave stone 20 into a conventional grinder tool. The user then closes the power switch upon the grinder tool which then rotates the shaft 40 and the concave stone 20 at significant rotational velocities. The user then positions the edge 22 of the concave stone 20 adjacent the surface of the wood 12 desired to create an eye effect within. The user then applies pressure to the wood 12 with the concave stone 20 rotating which causes portions of the wood 12 to be removed from the diamond grit surfaces 24, 26. The removed wood 12 is emitted through the slots 30 within the concave stone 20 thereby preventing accumulation within the concave stone 20. The user continues to extend the concave stone 20 into the wood 12 until the entire interior surface 24 of the concave stone 20 is engaging the wood 12. The user then may either terminate the cutting of the wood 12, or the user may continue applying the concave stone 20 to the portion of the wood 12 to create a deeper convex portion 14 within the wood 12. When the user removes the concave stone 20, a convex portion 14 remains within the wood 12 as best shown in FIG. 4 of the drawings. The user may utilize various other tools to add various effects around and within the convex portion 14.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cutting apparatus, comprising:

a concave blade having an interior surface and an exterior surface;

a first layer of course material covering all of said interior surface; and a shaft concentrically secured to said concave blade;

wherein said concave blade includes at least one slot, wherein said at least one slot extends longitudinally within said concave blade wherein said at least one slot is tapered upwardly having a broad lower portion and a narrow upper portion.

2. The cutting apparatus of claim 1, wherein said first layer of course material is comprised of a diamond grit.

3. The cutting apparatus of claim 1, wherein said exterior surface includes a second layer of course material.

4. The cutting apparatus of claim 3, wherein said second layer of course material is comprised of a diamond grit.

5. The cutting apparatus of claim 1, wherein said first layer of course material is comprised of a diamond grit.

6. The cutting apparatus of claim 1, wherein said at least one slot includes a slanted edge for engaging a piece of wood.

7. The cutting apparatus of claim 1, wherein said concave blade comprises a first slot and a second slot.

8. The cutting apparatus of claim 7, wherein said first slot and said second slot are in opposition to one another.

9. The cutting apparatus of claim 7, wherein said first layer of course material is comprised of a diamond grit.

10. The cutting apparatus of claim 7, wherein said exterior surface includes a second layer of course material.

11. The cutting apparatus of claim 9, wherein said second layer of course material is comprised of a diamond grit.

12. The cutting apparatus of claim 7, wherein said second slot is tapered upwardly each having a broad lower portion and a narrow upper portion.

13. The cutting apparatus of claim 12, wherein said first layer of course material is comprised of a diamond grit.

14. The cutting apparatus of claim 7, wherein said first slot and said second slot each include a slanted edge for engaging a piece of wood.

* * * * *